US005201466A

United States Patent [19]

Hynds

[11] Patent Number: 5,201,466

[45] Date of Patent: Apr. 13, 1993

[54] SPRAY GUN HAVING A ROTATABLE SPRAY HEAD

[76] Inventor: James E. Hynds, 7174 Creeks Crossing, West Bloomfield, Mich. 48322

[21] Appl. No.: 823,603

[22] Filed: Jan. 17, 1992

Related U.S. Application Data

[63] Continuation of Ser. No. 510,174, Apr. 17, 1990, abandoned.

[51] Int. Cl.[5] ..... B05B 3/02

[52] U.S. Cl. ..... 239/263; 239/263.3; 239/296; 239/405; 239/497

[58] Field of Search ..... 239/263, 263.3, 264, 239/290, 291, 293, 296, 497, 587, 223, 224, 405, 214; 415/122.1, 124.1; 427/27; 118/630, 631

[56] References Cited

U.S. PATENT DOCUMENTS

| | | | |
|---|---|---|---|
| 513,167 | 1/1894 | Woodhouse . | |
| 562,819 | 6/1896 | Gifford . | |
| 1,433,160 | 10/1922 | Shoemaker | 415/122.1 |
| 1,745,972 | 2/1930 | Beck . | |
| 1,976,062 | 10/1934 | Estep | 239/497 |
| 2,017,467 | 10/1935 | Loomis | 239/497 |
| 2,075,589 | 3/1937 | Munz | 239/497 |
| 2,177,851 | 10/1939 | Wallace | 239/293 |
| 2,596,191 | 5/1949 | Windhom, Jr. . | |
| 2,792,786 | 5/1957 | Nielsen | 415/122.1 |
| 3,027,095 | 3/1961 | Paasche . | |
| 3,095,148 | 6/1963 | Smith | 239/264 |
| 3,546,945 | 12/1970 | Collins | 415/122.1 |
| 3,827,309 | 3/1973 | Dooley . | |
| 3,987,963 | 10/1976 | Pacht . | |
| 4,058,258 | 11/1977 | Rosen et al. | 239/224 |
| 4,125,035 | 11/1978 | Dooley . | |
| 4,205,791 | 6/1980 | Dooley . | |
| 4,334,649 | 6/1982 | Dooley . | |
| 4,624,412 | 11/1986 | Hunter | 239/240 |
| 4,905,905 | 3/1990 | Hufgard . | |
| 4,911,365 | 3/1990 | Thiel et al. | 239/291 |
| 4,915,303 | 4/1990 | Hufgard | 239/290 |

*Primary Examiner*—Andres Kashnikow
*Assistant Examiner*—Christopher G. Trainor
*Attorney, Agent, or Firm*—Brooks & Kushman

[57] ABSTRACT

A spray gun including a rotatable spray head for creating a spiral flow of shaping air to more effectively apply multiple coats of liquid spray onto an article without dripping. The spiral flow of shaping or fanning air is further created by a turbine mechanism or air distributor. A drive mechanism, including a reversible motor, alternately rotates the spray head in either a clockwise direction or a counter clockwise direction relative to a housing assembly of the spray gun, depending on the direction of movement of the spray gun. In this way, the spray gun can effectively apply the liquid spray to the sides of an article, such as a grill, having a plurality of parallel, spaced portions. Preferably, the motor is an air motor having a drive shaft on which gearing is mounted for rotation therewith. A cylindrical portion of the housing assembly rotatably supports the spray head by bearings mounted thereon. The improved spray gun is particularly useful in paint spray systems wherein air having a flow rate in excess of 5 CFM and a delivery pressure of less than 15 psi over atmospheric is communicated to the spray head of the spray gun.

11 Claims, 2 Drawing Sheets

SPRAY GUN HAVING A ROTATABLE SPRAY HEAD

This is a continuation of co-pending application Ser. No. 510,174 filed on Apr. 17, 1990 now abandoned.

TECHNICAL FIELD

This invention relates to spray guns and, in particular to spray guns including spray heads with at least one shaping air orifice to provide fanning air.

In conventional paint spray guns, a stream of paint under pressure is discharged from a relatively small orifice in a nozzle while air under pressure is discharged into the stream from an annular opening surrounding the nozzle to atomize the stream of paint into a spray of fine particles. As it moves away from the gun, the spray defines a conical pattern whose apex is at the nozzle.

It is often desired to modify the circular cross-section of the normal conical spray pattern. This process is called fanning. This is typically accomplished by providing at the front end of the gun a spray head including an air cap having a pair of diametrically opposed ports which direct air jets toward opposite sides of the spray pattern to flatten the sides of the conical pattern.

In many prior art paint spray guns, adjustment of the fanning of the air is made by rotatably adjusting the air cap. This adjustment exerts a valving action which establishes a maximum airflow when the diametrically opposed valve ports lie in either a vertical plane containing the nozzle access or a horizontal plane containing the nozzle access.

Numerous prior art patents disclose paint spray guns in which fanning is adjustably controlled independently of the rotative orientation of the air cap by a valve member which is received within a spray gun housing for movement between fully open and fully closed positions. A manual operable mechanism adjusts the position of the valve member in the housing. The atomizing and fanning air are discharged from a single chamber formed in the air cap forward of the valve member prior to discharge into atomizing and fanning ports. Examples of such prior art patents include U.S. Pat. Nos. 1,849,300, 2,740,670 and 4,744,518.

U.S. Pat. Nos. 4,531,675 to Muck discloses a paint spray gun including a nozzle assembly which can be adjusted by a rotation plate to change air flow patterns and thereby the paint pattern.

U.S. Pat. No. 4,798,335 to Tachi et al discloses a paint spray device with a rotating head and air outlet ports for jetting out a stream of air in order to vary the paint pattern.

U.S. Pat. Nos. 4,214,708, 4,337,895 and 4,405,086 all show rotating atomizers.

One problem with such prior art paint spray guns is that the air discharged from the fanning ports fail to uniformly flatten the sides of the conical spray pattern against which they are directed and, consequently, do not properly control the shape of the spray pattern. This is caused by turbulence of the fanning air. One result is that when multiple coats of spray paint are to be applied to an article, the coats are not evenly applied and excess paint is used. This is especially troublesome in paint spray systems where the atomizing air has a flow rate in excess of 5 CFM at the spray head and a delivery pressure of less than 15 psi over atmospheric pressure at the spray head.

Another problem with such guns is that the atomizing air may not properly atomize the paint spray.

Still another problem is that with such guns the spray pattern does not effectively reach the sides of an article having multiple parallel sides such as a grill without multiple reciprocating spray gun passes.

DISCLOSURE OF THE INVENTION

An object of the present invention is to provide a spray gun including a rotatable spray head for rotating fanning air wherein the fanning air is derived from pressurized air having a flow rate in excess of 5 CFM at the spray head of the gun and a delivery pressure of less than 15 psi over atmospheric pressure at the spray head.

Still another object of the present invention is to provide a spray gun including a rotatable spray head for rotating the fanning air to more effectively control the shaping and delivery of a conical spray pattern wherein at least one spiral flow of fanning air is created by the rotating spray head and wherein the spray head is rotatable in opposite directions depending on the direction of movement of the spray gun.

In carrying out the above objects and other objects of the present invention, the spray gun includes a housing assembly and an annular spray head mounted at the forward end of the housing assembly. The spray head has a central air discharge orifice which extends coaxially therethrough and at least one shaping air orifice. A nozzle is mounted on the housing assembly coaxially of the air discharge orifice. The nozzle has a liquid discharge orifice at the forward end for discharging liquid under pressure in a forwardly directed stream coaxially of the air discharge orifice. A first passage in the housing assembly supplies liquid under pressure to the liquid discharge orifice. A chamber is provided in the housing assembly and a mechanism is provided for supplying air under pressure to the chamber. A second passage in the housing assembly communicates pressurized air from the chamber to the air discharge orifice to atomize the liquid discharged from the liquid discharge orifice into a spray. A third passage in the spray head communicates pressurized air from the chamber to the at least one shaping air orifice in the spray head to control fanning of the spray. A mechanism is provided for rotatably mounting the spray head on the housing assembly. A drive mechanism rotatably drives the spray head relative to the housing assembly to control fanning of the spray by creating at least one spiral flow of shaping air.

Preferably, the spray head has a pair of diametrically opposed shaping air orifices to create two spiral flows of shaping air.

Also, preferably, the chamber supplies pressurized air having a flow rate in excess of 5 CFM and a delivery pressure of less than 15 psi. over atmospheric pressure.

The advantages accruing to a spray gun constructed in accordance with the above are numerous. For example, because the fanning air is created in a spiral flow, more effective control of the spray pattern is provided since turbulence is greatly reduced in the fanning air. Also, the liquid is more fully atomized. Multiple coats of the liquid spray are more evenly applied with less liquid spray wastage and without dripping. Finally, because the sprayhead of the spray gun can rotate in opposite directions, the spray gun can more effectively apply the liquid spray to articles having multiple sides such as grills.

Other advantages of the present invention will be readily understood as the same becomes better understood by reference to the following detailed description when considered in connection with the accompanying drawings.

BEST MODE FOR CARRYING OUT THE INVENTION

Figure 1:
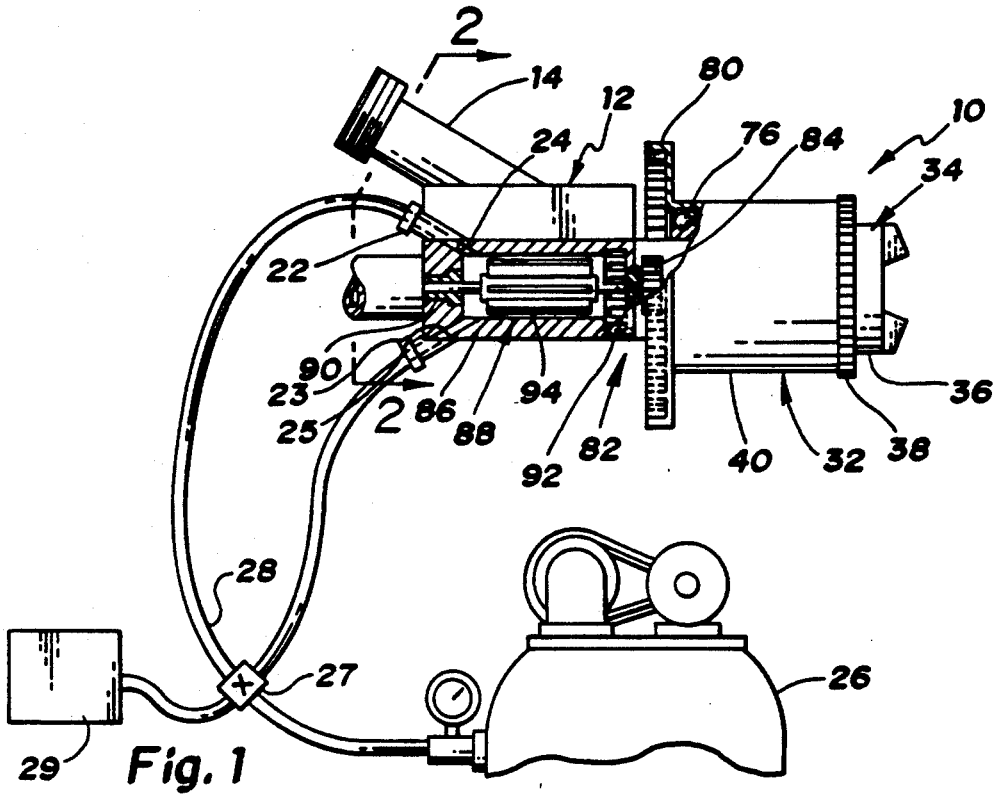
FIG. 1 is a view, partially broken away and in cross-section, of a spray gun of the present invention connected to a compressed air source.
Figure 2:
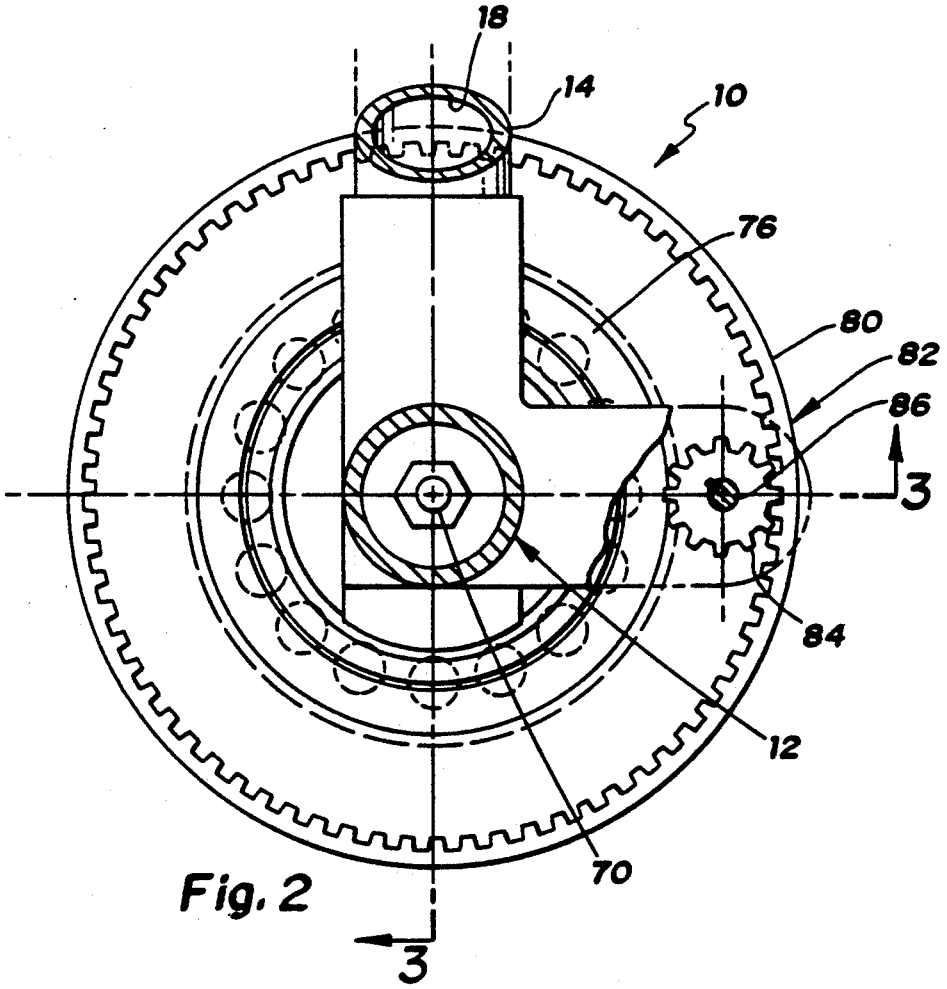
FIG. 2 is an enlarged view of the spray gun, partially broken away and in cross-section, taken along lines 2—2 of FIG. 1.
Figure 3:
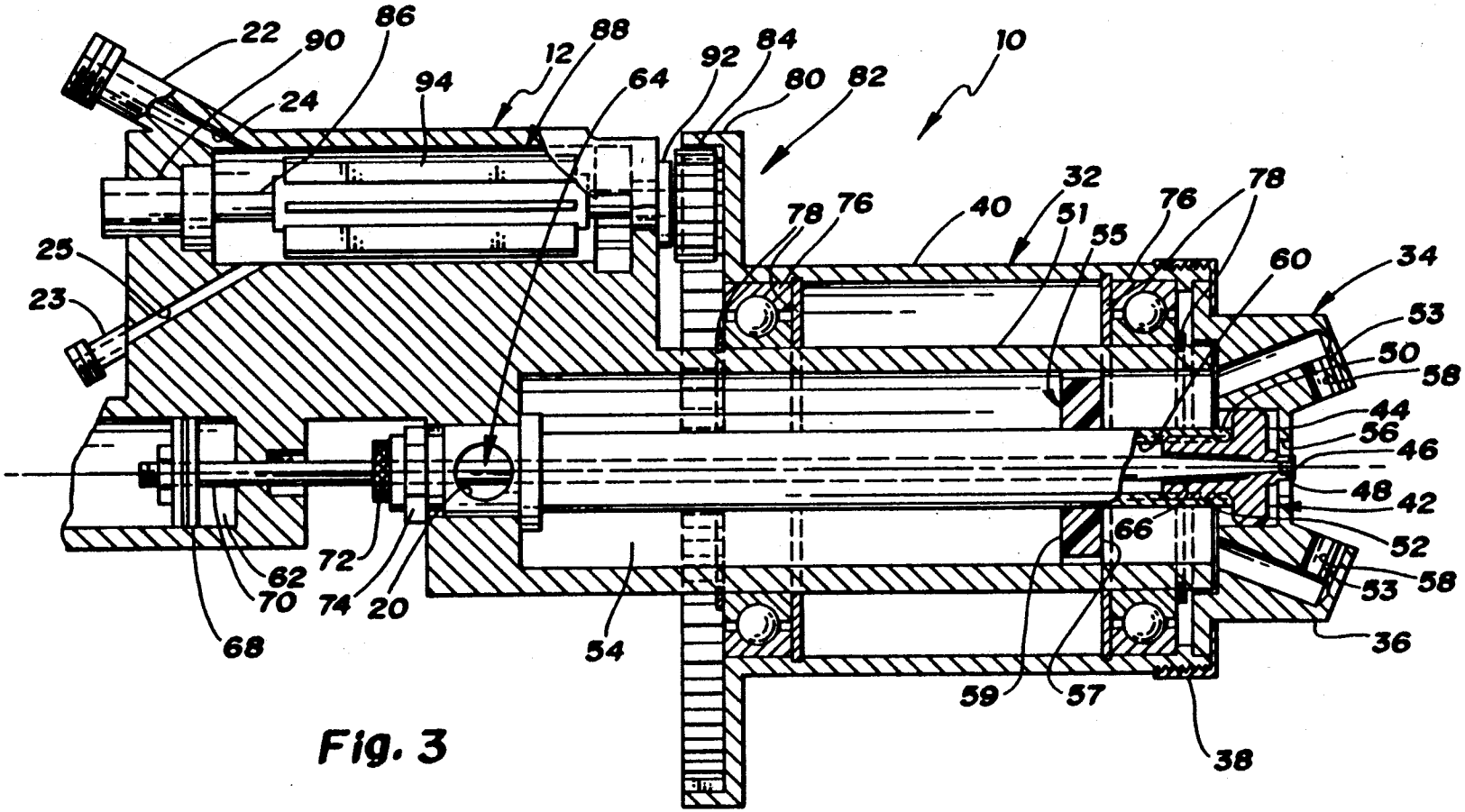
FIG. 3 is a view, partially broken away and in cross-section, of the spray gun taken along lines 3—3 of FIG. 2.

Referring to FIGS. 1, 2 and 3, there is illustrated a spray gun constructed in accordance with the present invention, and generally indicated at 10. The gun 10 includes a housing assembly, generally indicated at 12, which has an air inlet tube 14 and a fluid inlet tube (not shown) which define input air and input liquid coating passages 18 and 20, respectively. The housing assembly 12 also has a compressed air inlet tubes 22 and 23 which define air passages 24 and 25, respectively, for the supply of compressed air.

The compressed air is provided by a compressed air source 26 and is fluidly communicated to the air inlet tubes 22 and 23 by a hose 28 under control of an air solenoid 27. In turn, the solenoid 27 is controlled by a controller 29 which may comprise any type of automatic controller which may also control the movement of the spray gun 10 in an automatic system.

The air source 26 may be a conventional factory compressed air source. The compressed air operates a reversible air motor supported on the spray gun 10 as is described in detail below.

The gun 10 also includes an annular spray head, generally indicated at 32, mounted at the forward end of the housing assembly 12. In turn, the spray head 32 includes an air cap assembly, generally indicated at 34. The air cap assembly 34 includes a housing 36 and an internally threaded air cap fitting or nut 38 for securing the air cap assembly 34 to a cylindrical portion 40 of the spray head 32.

Referring specifically to FIG. 3, the gun 10 further includes a nozzle or tip, generally indicated at 42, having radially projecting wings 44. The nozzle 42 has an internal, tapered bore or liquid discharge orifice 46 at its forward end 48 and is threadedly secured within an internally threaded spool or barrel 50 at its rearward end 52. The nozzle 32 is preferably sealed by a tip gasket (not shown).

The input air passage 18 is in fluid communication with an annular air chamber 54 located about the barrel 50 within an internal cylindrical portion 51 of the housing assembly 12. In turn, the air chamber 54 is in fluid communication with a circular air discharge orifice 56 and first and second pairs of diametrically opposed shaping air orifices 58 and 53 formed in the housing 36 of the air cap assembly 34. The assembly 34 is threadedly connected to the rest of the gun 10 by the fitting 38 so that the liquid discharge orifice 46 formed in the nozzle 42 is centrally disposed within the air discharge orifice 56.

The gun 10 includes a turbine means or mechanism, generally indicated at 55, having a forward end 57 and a rearward end 59. The turbine mechanism 55 is located in the chamber 54 coaxially of the air discharge orifice 56 for receiving pressurized air from the chamber 54 at its rearward end 59 and creating a spiral flow of air at its forward end 57. A turbine mechanism having a similar structure and function is illustrated in U.S. Pat. No. 4,911,365 having the same Assignee as the present application.

The pair of diametrically opposed shaping air orifices 58 and 53 are directed towards the coating material sprayed from the nozzle 42 to partially atomize the coating material and to shape the resulting pattern of atomized liquid coating material.

The liquid coating passage 46 is in fluid communication with a first passage or bore 60 formed in the barrel 50. In turn, the first passage 60 communicates with the liquid discharge orifice 46.

The gun 10 preferably includes a mounting rod (not shown) for mounting the gun 10 to a spray fixture for automatic operation under control of air control signals at a control air passage 62. However, it is to be understood that the gun 10 may be modified for manual operation.

The flow of liquid coating material through the barrel 50 and the nozzle 42 is controlled by a control pin or valve, generally indicated at 64. The pin 64 has a tapered forward end portion 66 which selectively opens or closes the liquid discharge orifice 46 in the nozzle 42 upon axial movement thereof.

The air control signals in the passage 62 control the position of a piston member 68 concentrically mounted rearward on a rear end portion 70 of the pin 64 within the passage 62. The piston 68 is fixedly secured to the rear end portion 70 of the pin 64 so that the pin 64 moves axially when the piston member 68 moves within the passage 62. In other words, the pin 64 moves axially between its open and closed positions when the piston member 68 receives control signals on one end surface thereof.

A packing nut and bolt assembly 72 fluidly seals the pin 64 within the barrel 50. A locking nut 74 secures the barrel 50 within the housing assembly 12. Preferably, an adjustment screw (not shown) adjusts the position of the pin 64 within the barrel 50 and a check nut (not shown) secures the desired position.

The spray head 32 is rotatably mounted on the housing assembly 12 and, in particular, on the cylindrical portion 51 by bearings 76. The bearings 76 are held spaced apart on the portion 51 by snap rings 78.

The cylindrical portion 40 is preferably integrally formed with a driven gear 80 of a gear mechanism, generally indicated at 82. The driven gear 80 is coupled to a drive or pinion gear 84 which is mounted on a rotary drive shaft 86 of a reversible air motor, generally indicated at 88. The drive shaft 86 is mounted for rotation within the housing assembly 12 by supports 90 and 92 at opposite ends thereof.

Various apertured, annular plates or blades 94 are mounted on the shaft 86 to rotate the shaft 86 when compressed air flows through the air inlet tube 22 and across the blades 94. After flowing across the blades 94 the compressed air exits the air motor 88 at vents at the rear of the motor.

Alternatively, the gear mechanism 82 may be driven by a cable which is coupled to the drive gear 92 at one end thereof and at its opposite end to an air motor.

Obviously, many other arrangements can be provided for rotatably driving the spray head 32. For example, gear mechanism 82 may be eliminated by attaching air fins to the cylindrical portion 40 in the space defined by the cylindrical portions 40 and 51. Pressurized air passing over the fins would cause the cylindrical portion 40 and, consequently, spray head 32 to rotate.

The spiral flows of air caused by rotating the spray head and, consequently, the air cap assembly 34, control fanning of the spray by minimizing turbulence within the spray. Also, such fanning air assists in the liquid atomization process. Such turbulence is particularly troublesome when the air flow rate at the air cap assembly 34 is in excess of 5 CFM and has a delivery pressure of less than 15 psi. over atmospheric pressure, as provided in U.S. Pat. No. 4,761,299 having the same Assignee as the present application.

As can be readily appreciated by one of ordinary skill in the art, the invention of FIGS. 1 through 3 can be conveniently employed with a manually operable gun body, which may be either metallic or plastic in construction.

The spray gun 10 of the present invention provides numerous advantages. For example, rotation of the spray head 32 at a relatively constant speed of, for example, 60 rpm, creates spiral flows of fanning air at the shaping air orifices 58 to provide an effective mechanism to control fanning of the liquid atomized spray discharged from the nozzle 42. This is particularly advantageous when applying multiple coats of the liquid spray to more uniformly apply the coats without using an excess of liquid. Also, the spray gun 10 provides air which effectively atomizes the liquid spray. Finally, because the motor 88 is reversible, the direction of rotation of the spray head 32 can be varied depending on the direction of movement of the gun 10 to more effectively spray the sides of multi-sided articles, such as grills.

While the best mode for carrying out the invention has been described in detail, those familiar with the art to which this invention relates will recognize various alternative ways of practicing the invention as defined by the following claims.

What is claimed is:

1. In a spray gun including a housing assembly; an annular spray head mounted at the forward end of said housing assembly; said spray head having a central air discharge orifice extending coaxially therethrough and at least one shaping air orifice; a nozzle mounted on said housing assembly coaxially of said air discharge orifice; said nozzle having a liquid discharge orifice at its forward end for discharging liquid under pressure in a forwardly directed stream coaxially of said air discharge orifice; first passage means in said housing assembly for supplying liquid under pressure to said liquid discharge orifice; chamber means in the housing assembly; means for communicating pressurized air having a flow rate in excess of 5 CFM and a delivery pressure of less than 15 psi over atmospheric pressure to the chamber means; second passage means in said housing assembly for communicating air from the chamber means to said air discharge orifice to atomize liquid discharged from said liquid discharge orifice into a spray; third passage means in said spray head for communicating air from the chamber means to said shaping air orifices in said spray head to control fanning of the spray; the improvement comprising: means for rotatably mounting the spray head on the housing assembly; drive means for rotatably driving the spray head relative to the housing assembly to create at least one spiral flow of shaping air; wherein said drive means includes a reversible motor to drive the spray head and automatic control means for automatically controlling the reversible motor and for automatically controlling movement of the spray gun wherein the at least one spiral flow of shaping air is capable of automatically flowing in opposite directions dependent on the direction of movement of the spray gun.

2. The invention as claimed in claim 1 further comprising turbine means having a forward end and a rearward end, the turbine means being coaxially of said air discharge orifice for receiving pressurized air from the chamber means at the rearward end and creating a spiral flow of air at its forward end.

3. The invention as claimed in claim 1, wherein the spray head has a pair of diametrically opposed shaping air orifices to create two spiral flows of shaping air.

4. The invention as claimed in claim 1 wherein the spray head includes an air cap having the central air discharge orifice and the at least one shaping air orifice.

5. The invention as claimed in claim 1 wherein the reversible motor is an air motor mounted on the housing assembly and adapted to receive air under pressure to drive the spray head.

6. The invention as claimed in claim 1 or claim 5 wherein the reversible motor includes a rotary drive shaft and wherein said drive means further includes gear means having a first gear mounted on the drive shaft to rotate therewith and a second gear for coupling the first gear and the spray head in driving engagement.

7. The invention as defined in claim 1 wherein said first passage means is defined by a hollow tubular member secured to and extending coaxially rearwardly from said nozzle.

8. The invention as defined in claim 7 wherein said chamber means includes an annular chamber formed in the housing assembly and coaxially surrounding said tubular member rearward of the nozzle.

9. The invention as defined in claim 1 or claim 8 wherein said housing assembly includes a cylindrical portion extending coaxially rearward from said nozzle, said cylindrical portion defining a portion of the chamber means.

10. The invention as defined in claim 9 wherein said means for rotatably mounting includes bearing means mounted on said cylindrical portion to rotatably support the spray head.

11. In a spray gun including a housing assembly; an annular spray head mounted at the forward end of said housing assembly; said spray head having a central air discharge orifice extending coaxially therethrough and a pair of diametrically opposed shaping air orifices, a nozzle mounted on said housing assembly coaxially of said air discharge orifice; said nozzle having a liquid discharge orifice at its forward end for discharging liquid under pressure in a forwardly directed stream coaxially of said air discharge orifice; first passage means in said housing assembly for supplying liquid under pressure to said liquid discharge orifice; chamber means in the housing assembly; means for communicating pressurized air having a flow rate in excess of 5 CFM and a delivery pressure of less than 15 psi over atmospheric pressure to the chamber means; second passage means in said housing assembly for communicating air from the chamber means to said air discharge orifice to atomize liquid discharged from said liquid discharge orifice into a spray; third passage means in said spray head for communicating air from the chamber means to said shaping air orifices in said spray head to control fanning of the spray; the improvement comprising: means for rotatably mounting the spray head on the housing assembly; drive means for rotatably driving the spray head relative to the housing assembly to create two spiral flows of shaping air; wherein said drive means includes a reversible air motor mounted on the housing assembly and adapted to receive air under pressure to drive the spray head; and control means for automatically controlling the reversible air motor and for automatically controlling movement of the spray gun; whereby the two spiral flows of shaping air are capable of automatically flowing in opposite directions dependent on the direction of movement of the spray gun.

* * * * *